United States Patent [19]

Coliva

[11] 4,219,942

[45] Sep. 2, 1980

[54] CONTINUOUS DRYING CHAMBER

[75] Inventor: Luigi Coliva, Muggio', Italy

[73] Assignee: Essico S.r.l., Milan, Italy

[21] Appl. No.: 912,769

[22] Filed: Jun. 5, 1978

[30] Foreign Application Priority Data

Jun. 8, 1977 [IT] Italy ..... 24474 A/77

[51] Int. Cl.[2] ..... F26B 19/00

[52] U.S. Cl. ..... 34/203; 34/155; 34/159; 34/164; 34/232

[58] Field of Search ..... 34/201, 203, 205, 207, 34/208, 232, 155, 159, 164, 236

[56] References Cited

U.S. PATENT DOCUMENTS

| | | | |
|---|---|---|---|
| 901,191 | 10/1908 | Sargent | 34/203 |
| 2,365,769 | 12/1944 | Marshall | 34/203 X |
| 3,266,559 | 8/1966 | Osbourne et al. | 34/232 X |
| 3,272,156 | 9/1966 | Gilgore et al. | 34/208 X |
| 3,448,524 | 6/1969 | Hildebrand | 34/205 X |
| 3,839,803 | 10/1974 | Dick | 34/203 |

*Primary Examiner*—Edward G. Favors
*Attorney, Agent, or Firm*—Fleit & Jacobson

[57] ABSTRACT

A continuous drying system for fabrics, comprising fabric inlet and outlet means, respectively; means for continuously introducing the fabric into the chamber and laying it down on at least one conveyor moving it to said outlet means. A system for drying air circulation comprises at least one fan unit having its delivery side connected through an air heating unit to at least one blowing channel overlying the fabric on the conveyor, and the intake or suction side is connected to at least one channel underlying the fabric to keep a circulation of an air flow passing through the fabric to be dried.

10 Claims, 4 Drawing Figures

CONTINUOUS DRYING CHAMBER

This invention relates to a continuous drying chamber, by means of which a fabric can be subjected to a shrinking process in order to return dimensional stability to the fabric. A continuous drying chamber according to the present invention can be used in shrinking operations for open and tubular knitted fabrics, as well as for general fabrics both of cotton, synthetic and mixed or unions.

As well known, a dimensional stability must be provided to a fabric to maintain its characteristics at unaltered condition even after the manufacture of a general article of clothing. At present, a machine for providing a dimensional stability to a fabric by a mechanical treatment is known. However, a mechanically stabilized fabric, when subjected to normal homely washings, would lose most of its characteristics. Systems are also known as providing to dip a fabric in baths with long processing times and requiring a high waste of power.

Therefore, it is the object of the present invention to provide a continuous drying chamber, by means of which a fabric shrinkage can be carried out, to give a dimensional stability by a thermal effect due to a flow of hot air running over and passing through the fabric. Preferably, a humidification of the fabric may be provided by atomized jets of water and chemical wetting agents, or by means of steam or steam mixed with water according to the type of fabric.

Generally, according to the invention, a continuous fabric drier has been provided, comprising a drying chamber defining an inlet and respectively an outlet for a fabric; means for continuously introducing a fabric through said inlet to the chamber and laying it down on at least one conveyor moving it to an outlet; a hot air recirculating system being also provided and comprising at least one fan unit having its delivery side connected through an air heating unit to at least one blowing channel overlying the fabric on said conveyor, and having its intake side connected to at least one suction channel underlying said fabric to keep a continuous circulation of a hot air flow passing through the loops of a fabric to be dried.

Preferably, the drying system is provided with two or more continuous conveyors superimposed to one another, having suitable means for causing a fabric to move from a conveyor to the underlying conveyor, the latter moving at a different speed, for example at a lower speed, to compensate for the fabric shrinkage. Preferably, the conveyors comprise vibrating belts promoting a sliding of the fabric fibers which, under the effect of hot air, would tend to swell and re-enter.

According to a further of the invention, said channels for blowing and sucking air through the fabric loops, have slits arranged slantwise of the fabric path, with the blowing slits oriented in opposite direction to the sucking slits. In addition to allowing a good air distribution on the fabric, this system prevents the fabric from being moved or displaced on the conveyor belt. Moreover, because of being oppositely directed, the two air streams will promote the fabric stretching. Finally, the crossed arrangement of the air blowing and sucking slits enable the blown air passing through the fabric to impact partially on the underlying conveyor prior to being sucked through the latter, whereby local swellings are formed in the fabric, thus improving the settling and drying thereof.

These and further features of a drying system according to the present invention will become more apparent from the following description given with reference to the accompanying drawings, in which.

Figure 1:
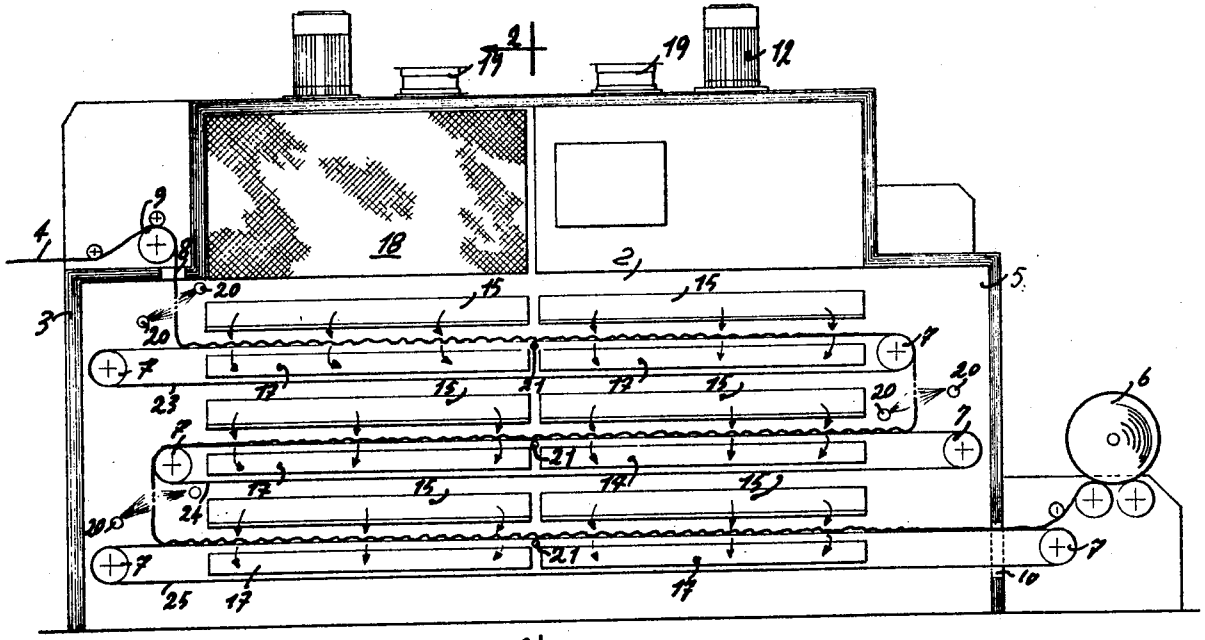
FIG. 1 is a longitudinal sectional view of a drier according to the invention.
Figure 2:
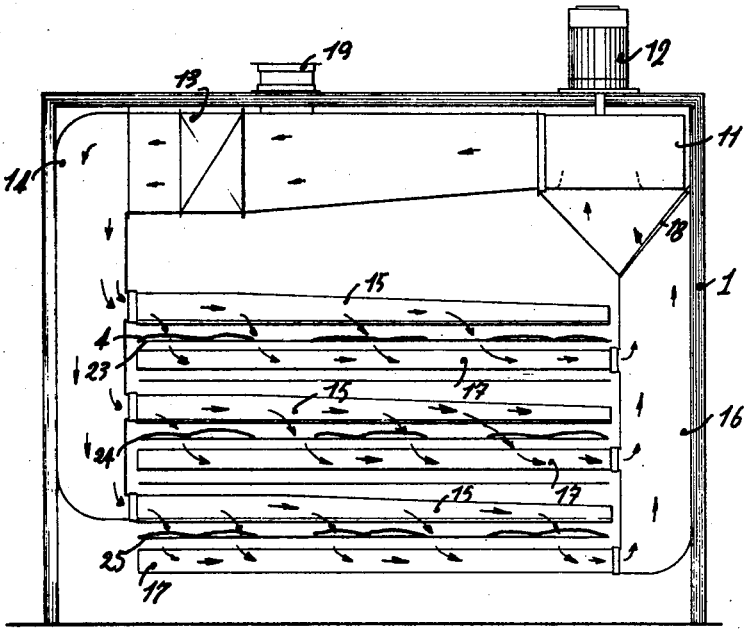
FIG. 2 is a cross-sectional view of the drier substantially taken along line 2-13 2 of FIG. 1.

As shown from FIGS. 1 and 2, a drying system substantially comprises a central body 1, in the case including two or more modular sections, defining a drying chamber 2 provided with a head 3 for the entry of a fabric web 4 to be dried, and a head 5 for the outlet of a dried fabric which may be wound up to form a roll 6.

Internally of said drying chamber 2, there are conveyor belts 23, 24 and 25 at superimposed positions to one another, on which a fabric 4 is laid down and transferred at relaxed condition from inlet head 3 to outlet head 5. As shown in the enlarged sectional view of FIG. 3 and as explained hereinafter, each of the continuous conveyors comprise a foraminous belt to afford the passage of hot drying air through the fabric loops. Said continuous conveyors 23, 24 and 25 are fitted on suitably powered end guide cylinders 7 to drive each conveyor independently of the other conveyors and at speeds varying as required. Particularly, in the exemplary embodiment shown, three superimposed conveyors are used, of which the upper conveyor 23 and the lower conveyor 25 move in the direction of said outlet head 5, and the intermediate conveyor 24 moves in opposite direction.

From the sectional view of FIG. 1, it will be also seen that said upper conveyor 23 extends under a fabric entry opening 8 of said end head 3, at which a supply calender 9 is located, the calender continuously laying out the fabric on the underlying conveyor 23. From this FIG. 1, it will be also seen that the last conveyor 25 partly projects from an opening 10 in the end wall of the fabric outlet head 5.

The drier according to the invention further comprises a system for hot air circulation through the fabric loops. As shown in the sectional views of FIGS. 1 and 2, such a system in the exemplary embodiment shown comprises two fan units 11, each of which operated by a separate electric motor 12 for continuous circulation of hot air through the fabric loops on said conveyors 23, 24 and 25. Particularly, the delivery side of each fan unit is connected, through an air heating unit 13 comprising, for example, a battery of finned tubes run through by a hot fluid or the like and through a branch pipe 14, to the air blowing channels 15, the latter being located at the top of the fabric at a short distance from the upper run of the conveyor. Similarly, the intake or suction side of fan unit 11 is connected, through a branch pipe 16, to corresponding sucking channels 17 located under the upper run of each conveyor to suck the air blown at the top both through the fabric loops 4 and through the holes of the conveyor. This detail is more clearly shown in the enlarged sectional view of FIG. 3. A filter 18 is provided on the intake side of fan unit 11 for the required air filtering. The drying system is also provided with normal openings 19 for the replacement of moist or wet air within the drying chamber.

Figure 3:
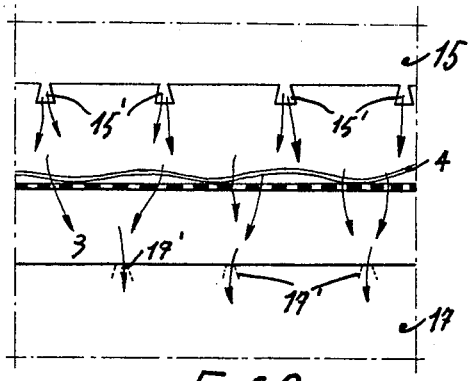
FIG. 3 is an enlarged detail of a fabric conveyor belt with the respective air blowing and sucking channels.
Figure 4:
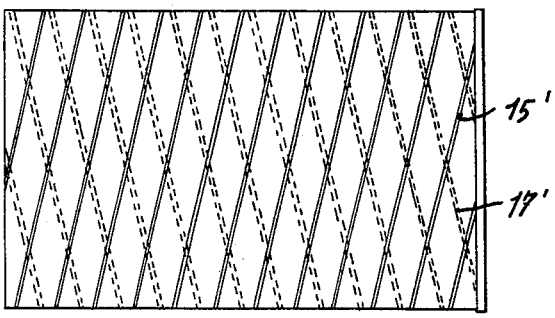
FIG. 4 is a sketch for showing the crossed arrangement for the slits of a blowing channel and a sucking channel, respectivley, of the air passing through a fabric to be dried.

FIGS. 3 and 4 of the accompanying drawings show a further feature of the present invention relating to the air blowing and sucking channels through the fabric. Thus, said figures show that blowing channels 15 on the side facing the underlying conveyor are provided with blowing slits 15' arranged transversely of and slantwise to the fabric feeding direction. Similarly, each sucking channel 17 is provided with sucking slits 17' arranged transversely and slantwise, but with an inclination opposite to those of said blowing slits 15'. By way of example, it should be specified that the slit inclination relative to the fabric feeding direction may form an angle between 10° and 15°.

The drying system may be also provided with fabric wetting nozzles 20 upstream of each conveyor, such as by steam and/or water jets according to the type of fabric being treated. Finally, it should be specified that said conveyors 23, 24 and 25 may be caused to vibrate by means, for example, of rotating cams 21 or the like, as schematically shown in FIG. 1, to promote fabric stretching or laying out.

The operation of the above described drying system is substantially as follows.

The fabric as supplied from calender 9 is introduced into drying chamber 2 through inlet opening 8 and is then laid down on underlying conveyor 23 which moves at a lower speed than fabric feeding rate, so that the fabric will form small pleats. Prior to be laid down on upper conveyor 23, the fabric may in the case be wetted with steam and/or water jets from said nozzle 20.

As laid down on the upper run of conveyor 23, the fabric is advanced along the drying chamber and during its movement is run over at the top by hot air jets exiting from said blowing channel 15 and running over and passing through the fabric loops, as well as the conveyor, for suction by said underlying sucking channels 17. Sucked air is then filtered and recycled by fan unit 11, providing for supplying it again to the blowing channels through said heating unit 13.

Once the fabric has reached the opposite end of conveyor 23, it is caused to fall down on underlying conveyor 24 moving in opposite direction, where the fabric undergoes a further drying and stabilizing action due to the air flows from the blowing channel(s) 15 overlying conveyor 24 and sucked by sucking channels 17 interposed between the two runs of conveyor, just as in the case of the preceding conveyor. During the transition from upper conveyor 23 to intermediate conveyor 24, the fabric may be further wetted by steam and/or water jets from nozzles 20.

From intermediate conveyor 24 the fabric is caused to fall down again on lower conveyor 25 moving to outlet 5 in the direction of first mentioned conveyor 23, as above referred to. In the transition from conveyor 24 to conveyor 25, the fabric may be further wetted, as in the preceding cases, and then on said conveyor 25 the fabric undergoes the final shrinking or stabilizing and drying step. On exiting from the drying chamber on conveyor 25, the fabric is then wound up on roll or reel 6.

Accordingly, from the foregoing it would be apparent that a fabric, as being transferred along the drying chamber, in addition to being dried will undergo a shrinking and stabilizing effect promoted by the vibrations given to the conveyors causing a sliding of the fabric fibers which, under the action of hot air, tend to swell and re-enter. A thorough drying and stabilization of the fabric is further promoted by the crossed oblique arrangement of the blown and sucked air flows, as preventing the fabric from moving on the conveyor belts, thus promoting the stretching thereof. The crossed arrangement for the air blowing and sucking flows also affords the latter, on passing through the fabric, to impact on the underlying conveyor belt prior to suction, thus forming local swellings in the fabric aiding in settling and drying the latter.

What is claimed is:

1. A continuous drying system for fabrics, comprising a drying chamber defining fabric inlet and outlet means, respectively, means for continuously introducing the fabric into said chamber and laying it on at least one continuous conveyor moving it to said outlet means; means for vibrating said at least one conveyor so that fabric laid thereon is stretched and laid out; a system for circulation of drying air comprising at least one fan unit having its delivery side connected through an air heating unit to at least one blowing channel overlying the fabric on the conveyor, and having its intake or suction side connected to at least one air sucking channel underlying the fabric and through said conveyor for keeping a circulation of a hot air flow passing through loops of the drying fabric, said air blowing and sucking channels, respectively, being provided with transverse air slits slantwise arranged to the fabric feeding direction.

2. A drying system according to claim 1, comprising a plurality of mutually overlying continuous conveyors, and means for transferring the fabric from one conveyor to the underlying conveyor; the delivery and intake or suction sides, respectively, of said fan unit being connected with branch pipes to air blowing and sucking channels, respectively, associated with each conveyor for fabric drying on the conveyors.

3. A drying system according to claim 1, wherein the slits for each of said blowing channels are inclined in one direction and the slits for the respective sucking channel are inclined in the opposite direction.

4. A drying system according to claim 1 or claim 3, wherein the air slits form an angle of between 10° and 15° with respect to the fabric feeding direction.

5. A drying system according to claim 1 or claim 2, wherein a fabric wetting or evaporating device is provided upstream of each continuous conveyor.

6. A drying system according to claim 2, wherein a device is provided for vibrating each of the fabric conveyors.

7. A drying system according to claim 1, wherein the air sucking channel is interposed between the upper and lower runs of a foraminous conveyor belt.

8. A drying system according to claim 1, wherein said drying chamber comprises at least one modular central body and two end heads provided with means for continuously introducing and removing said fabric, respectively.

9. A continuous drying system for fabrics, comprising a drying chamber defining fabric inlet and outlet means, respectively; means for continuously introducing the fabric into said chamber and laying it on at least one continuous conveyor moving it to said outlet means; means for vibrating said at least one conveyor so that fabric laid thereon is stretched and laid out; a system for circulation of drying air comprising at least one fan unit having its delivery side connected through an air heating unit to at least one blowing channel overlying the fabric on the conveyor, and having its intake or suction side connected to at least one air sucking channel underlying the fabric and through said conveyor for keeping a circulation of a hot air flow passing through loops of the drying fabric, said continuous conveyor passing over end guides, and wherein said means for vibrating comprises a rotatable member disposed intermediate said end guides for vibrating said conveyor.

10. A drying system according to claim 9, wherein said rotating member is a rotating cam.

* * * * *